US006251552B1

(12) United States Patent
Nakayama et al.

(10) Patent No.: US 6,251,552 B1
(45) Date of Patent: Jun. 26, 2001

(54) METHOD AND APPARATUS OF DEVELOPING ELECTROPHOTOGRAPHIC MASTER PLATE FOR PRINTING

(75) Inventors: Takao Nakayama; Chiaki Kawamoto, both of Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/496,782

(22) Filed: Feb. 3, 2000

(30) Foreign Application Priority Data

Feb. 4, 1999 (JP) ..... 11-027533

(51) Int. Cl.[7] ..... G03G 13/26

(52) U.S. Cl. ..... 430/49; 430/62; 399/241

(58) Field of Search ..... 430/49, 62; 399/241

(56) References Cited

U.S. PATENT DOCUMENTS 3,794,539 * 2/1974 Komiya et al. ..... 430/49
3,804,620 * 4/1974 Wells ..... 430/49
4,120,720 * 10/1978 Gross ..... 430/62

* cited by examiner

*Primary Examiner*—John Goodrow
(74) *Attorney, Agent, or Firm*—Reed Smith LLP

(57) ABSTRACT

A conductive layer 5 and a photoconductive layer 7 are laminated on a support member 3 made of resin so that an electrophotographic master plate for printing is constituted. Electrode portions 5*a* electrically connected to the conductive layer 5 are formed on the widthwise directional side surfaces. When development is performed, the electrode portions 5*a* are brought into contact with an electrode 11 adjacent to the support member 3 so that the potential of the conductive layer 5 is made to be the same as the potential of the electrode 11 adjacent to the support member 3 though the electrode portions 5*a*. The developing apparatus has a structure for causing the electrode portions 5*a* to be grounded by a provided roller made of stainless steel and/or a conductive brush.

6 Claims, 5 Drawing Sheets

METHOD AND APPARATUS OF DEVELOPING ELECTROPHOTOGRAPHIC MASTER PLATE FOR PRINTING

BACKGROUND OF THE INVENTION

1. Field of the Invention

The present invention relates to a method and an apparatus for developing an electrophotographic master plate for printing, and more particularly to a method of developing an electrophotographic master plate for printing having an insulating support member on which a conductive layer and a photoconductive layer are laminated and a developing apparatus for performing the developing method.

2. Description of the Related Art

A planographic printing plate for use in an electrophotographic method is manufactured by a wet electrophotographic plate making machine structured as disclosed in Unexamined Japanese Patent Publication (kokai) No. 10-260597. The outline of the foregoing machine will now be described. An electrophotographic master plate for printing (hereinafter simply abbreviated as a "master") is conveyed to an electrifying portion to uniformly electrify the electrophotographic master plate for printing by virtue of corona discharge. Then, the electrophotographic master plate for printing is conveyed to an exposing portion to expose an image (an original document) to light. The master having the exposed image is conveyed to a developing apparatus also called a liquid-toner developing portion.

The wet electrophotographic developing apparatus is arranged to convey the master into toner developer enclosed between a pair of electrodes usually composed of a back plate (an electrode adjacent to a support member) and developing plate (an electrode adjacent to the surface which must be developed). Thus, toner development is performed in the toner developer. An example of a modification of the wet electrophotographic developing apparatus has been'disclosed in Unexamined Japanese Patent Publication (kokai) No. 9-96956. The foregoing apparatus is arranged to apply voltage to the pair of the electrodes during conveyance to form a toner image also using the foregoing function realized by the developer. The master incorporates a support member, such as paper to which conductivity has been imparted, and a photoconductive layer formed on the support member.

A portion of the masters incorporates the support member made of paper or the like and a photoconductive layer formed on the support member. The foregoing structure encounters irregularity in the density caused from states of tangling of pulp constituting the paper. Hence it follows that microscopic asperities are formed on the surface and, therefore, the flatness deteriorates. Moreover, permeability of coating solution encounters irregularity. Thus, the image quality deteriorates. Therefore, if the toner image is fixed as described above, improvement in the image quality has been limited.

To overcome the above-mentioned problems, it might be considered feasible to employ a resin sheet having flatness superior to that of the paper. The resin sheet, however, has no conductivity. Therefore, the resin sheet cannot be employed as the master which is developed by the electrophotographic developing apparatus.

SUMMARY OF THE INVENTION

It is an object of the present invention to provide a developing method and apparatus for wet-developing an electrophotographic master plate for printing which incorporates a resin sheet having an excellent electric insulating characteristic and satisfactory flatness.

(1) A method of developing an electrophotographic master plate for printing according to the present invnetion which incorporates an insulating support member, on which a conductive layer and a photoconductive layer are laminated, and electrode portions formed on the widthwise-directional side surfaces of said insulating support member and said photoconductive layer and arranged to electrically be connected to said conductive layer, said method of developing an electrophotographic master plate for printing comprising the step of: always electrically connecting said conductive layer to a conductive member through said electrode portions to ground said conductive layer during conveyance of said electrophotographic master plate for printing through a toner developer enclosed between a pair of electrodes disposed opposite to each other.

(2) An apparatus for developing an electrophotographic master plate for printing according to the present invention which incorporates an insulating support member, on which a conductive layer and a photoconductive layer are laminated, and electrode portions formed on the widthwise-directional side surfaces of said insulating support member and said photoconductive layer and arranged to electrically be connected to said conductive layer, said apparatus for developing an electrophotographic master plate for printing comprising: a conductive member which is previously grounded and is provided for a passage for conveying said electrophotographic master plate for printing to a toner developer enclosed between a pair of electrodes disposed opposite to each other, wherein said electrode portions and said conductive rollers are always brought into contact with each other during conveyance of said electrophotographic master plate for printing by conveying means so that said conductive layer is grounded.

(3) The apparatus for developing an electrophotographic master plate for printing according to (2), wherein said conductive member is conducitve rollers for conveying said electrophotographic master plate.

(4) The apparatus for developing an electrophotographic master plate for printing according to (2), wherein an electrode adjacent to said support member of said electrodes is previously grounded, and said electrode portions are brought into contact with said electrode adjacent to said support member during conveyance of said electrophotographic master plate for printing so that said conductive layer is grounded.

(5) The apparatus for developing an electrophotographic master plate for printing accorrding to (2), wherein said conductive member is a conductive brush.

(6) The apparatus for developing an electrophotographic master plate for printing accorrding to claim 2, wherein said conductive member is at least one of a conductive roller, an electrode adjacent to said support member, and a conductive brush, which are previously grounded.

The electrophotographic master plate for printing according to the present invention incorporates the support member which has an electric insulating characteristic and on which the conductive layer and the photoconductive layer are formed. Moreover, the electrode portions which are electrically connected to the conductive layer are provided for the two widthwise directional ends. When the electrophotographic master plate for printing is developed, the conductive layer is grounded through the electrode portions as described in the aspect (1).

To ground the electrode portions, any one of the following members disclosed in aspects (2) to (6) may be employed: the rollers for conveying the electrophotographic master plate for printing; the electrode which is disposed adjacent to the support member and which is an electrode for applying voltage to the electrophotographic master plate for printing; and the conductive brushes disposed at the positions at which contact with the electrode portions is permitted.

When the electrophotographic master plate for printing is developed, the electrophotographic master plate for printing is conveyed into a developer enclosed between the pair of electrodes (the electrode adjacent to the support member and the electrode adjacent to the surface which is developed) disposed to sandwich the electrophotographic master plate for printing from the two surfaces of the electrophotographic master plate for printing. At this time, the electrode portions provided for the electrophotographic master plate for printing are inevitably brought into contact with at least any one of the rollers for conveying the electrophotographic master plate for printing, the electrode adjacent to the support member or the conductive brushes. Since at least any one of the rollers, the electrode adjacent to the support member and the conductive brushes are previously grounded, also the conductive layer is grounded through the electrode portions. Thus, counter charges caused from the toner development are supplied from the ground so that the electrostatic latent image is neutralized. Hence it follows that satisfactory development can be performed.

As a matter of course, bias voltage may be applied between the pair of the electrodes (the electrode adjacent to the support member and the electrode adjacent to the surface which is developed) during the toner development to control the quantity of adhesion of toner.

PREFERRED EMBODIMENTS OF THE INVENTION

Figure 1:
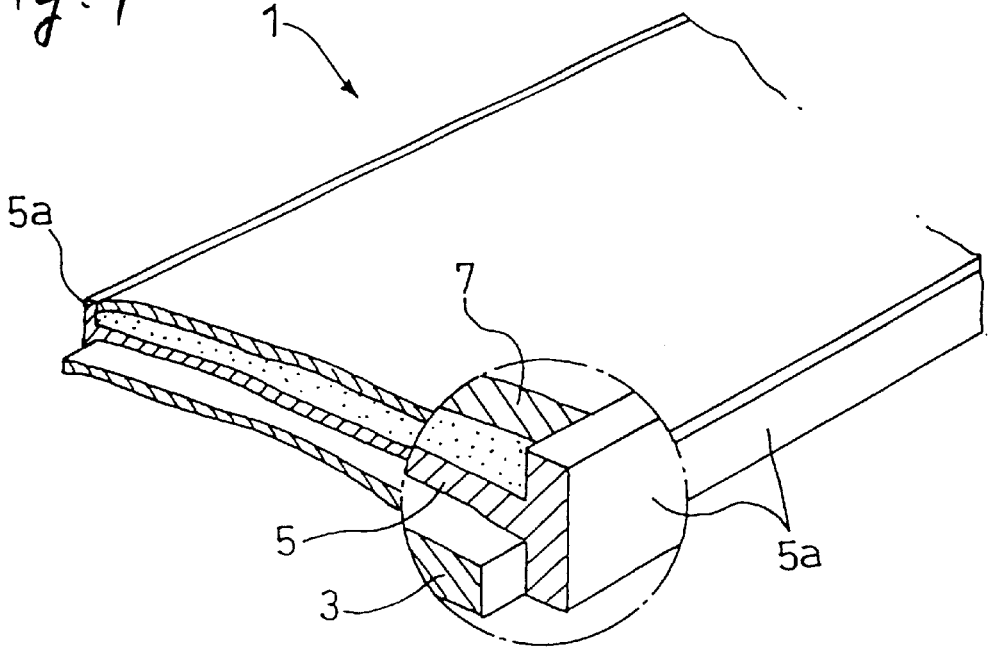
FIG. 1 is a perspective view schematically showing the structure of an electrophotographic master plate for printing according to the present invention.
Figure 2:
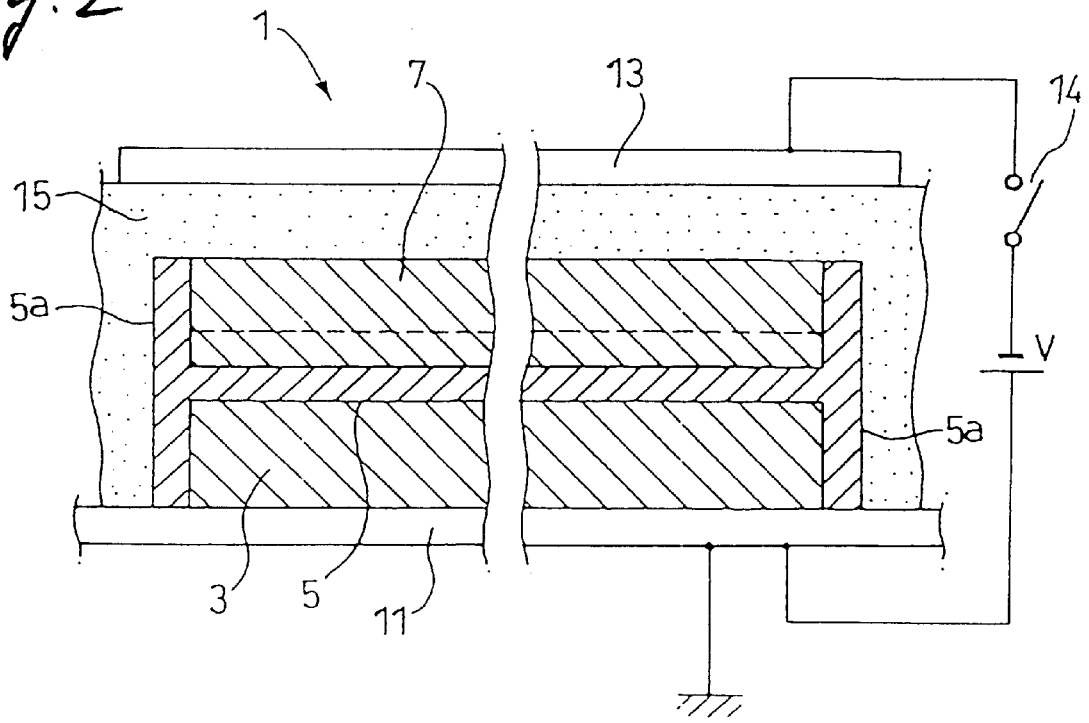
FIG. 2 is an enlarged cross sectional view showing an essential portion to describe the relationship between the structure of the electrophotographic master plate for printing and a pair of electrodes.

Referring to FIGS. 1 and 2, a first embodiment of an electrophotographic master plate for printing according to the present invention will now be described. FIG. 1 is a perspective view showing the structure of the electrophotographic master plate for printing (abbreviated as a "master" similarly to the foregoing description). FIG. 2 is a schematic cross sectional view showing a developing method.

The master 1 has a laminated structure as shown in FIGS. 1 and 2. The master 1 incorporates a sheet-shape support member 3 having an electric insulating characteristic having either surface (the upper surface in the structure shown in FIGS. 1 and 2) on which a conductive layer 5 is formed. Moreover, a photoconductive layer 7 is laminated on the upper surface of the conductive layer 5. The two widthwise directional side surfaces of the master 1 are provided with electrode portions 5*a* which cover the foregoing two side surfaces and which are electrically connected to the conductive layer 5.

To form the electrode portions 5*a*, the side surfaces of the original material for making the master 1 are coated with conductive solution. Then, the conductive solution is dried.

The development of the master 1 is performed by a developing apparatus to be described later. A case in which the electrode adjacent to the support member is grounded is taken as an example to describe the basic operation in the developing process.

When the master 1 is developed, the master 1 is allowed to pass through a toner developer 15 enclosed between an electrode 11 adjacent to the support member 3 and made of metal and an electrode 13 adjacent to the surface which is developed. According to the foregoing structure, the conductive layer 5 and the electrode portions 5*a* are electrically connected to each other. The lower ends of the electrode portions 5*a* are electrically connected to the electrode 11 adjacent to the support member 3. Since the electrode 11 adjacent to the support member 3 is grounded, also the potential of the conductive layer 5 is made to be the same level as that of the ground through the electrode portions 5*a*.

As a result, the surface of the master 1 which is developed is toner-developed. Thus, electric charges having a polarity opposite to that of the toner are, as counter charges, allowed to flow from the ground to the electrode 11 adjacent to the support member 3, the electrode portions 5*a* and the conductive layer 5. Therefore, the electrostatic latent image of the photoconductive layer 7 is neutralized. When a switch 14 is closed to apply voltage V having the same polarity as that of the surface charges to the electrode 13 adjacent to the surface which is developed, the fog level of toner in non-image portions can be lowered. Thus, contamination of the surface occurring in the printing operation can satisfactorily be prevented.

The electrode 11 adjacent to the support member 3 is formed into a shape like a sliding way. Since the master 1 is moved through the toner developer 15, the toner developer 15 is introduced between the master 1 and the electrode 11adjacent to the support member 3. In this case, there is apprehension that the contact between electrode portions 5*a* and the electrode 11 adjacent to the support member 3 becomes defective. However, the master 1 has a large area and the conductive layer 5 is uniformly formed in the overall inner portion of the master 1. Moreover, the electrode portions 5*a* are formed on the overall surfaces of the two side surfaces of the master 1. Therefore, ends of the electrode portions 5*a* are inevitably made contact with the electrode 11 adjacent to the support member 3. Therefore, the above-mentioned operation can reliably be performed.

Although the embodiment of the master 1 is structured as described above, the structure is not limited to the foregoing arrangement. A structure shown in FIG. 3 may be employed.

That is, a master 1 shown in FIG. 3 has a structure that an electrode portion 5*a* extends below the support member 3. The foregoing structure enables the area of contact between the electrode portion 5*a* and the electrode 11 adjacent to the support member 3 to be enlarged. Hence it follows that the connection between the support member 3 and the electrode 11 adjacent to the conductive layer 3 can furthermore reliably be established.

Since the counter charges are supplied from the ground owing to the toner development operation, adhesion of toner to the photoconductive layer 7 can reliably be performed. Therefore, a uniform image can be formed.

Figure 3:
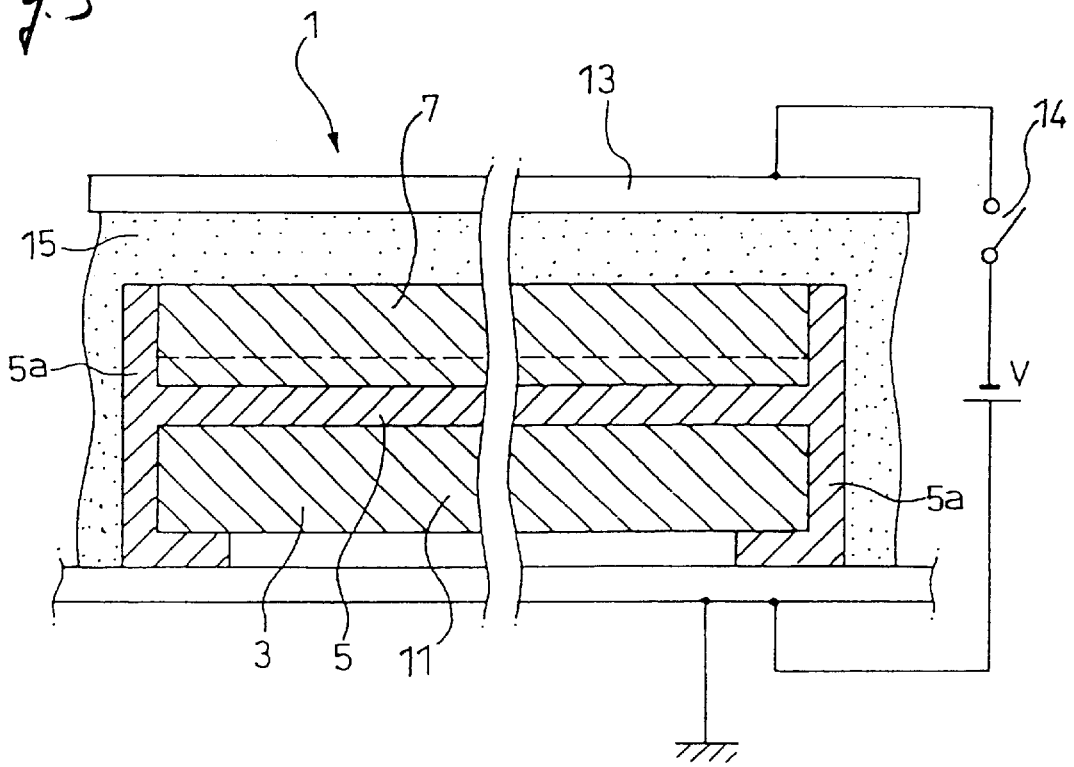
FIG. 3 is an enlarged cross sectional view showing an essential portion of another structure of the electrode portion.

If necessary, a blocking layer may be formed between the conductive layer 5 and the photoconductive layer 7, as indicated with dashed lines shown in FIGS. 2 and 3. The necessity of the blocking layer is determined depending on the electrical and physico-chemical combinations of the conductive layer 5 and the photoconductive layer 7.

The electrode portion 5*a* is formed from the end of the master 1 to extend as described above within a range permitted from a viewpoint of practical use. The width of the electrode portion 5*a* is, for example, 5 mm or smaller, preferably 0.5 mm or smaller.

Figure 4:
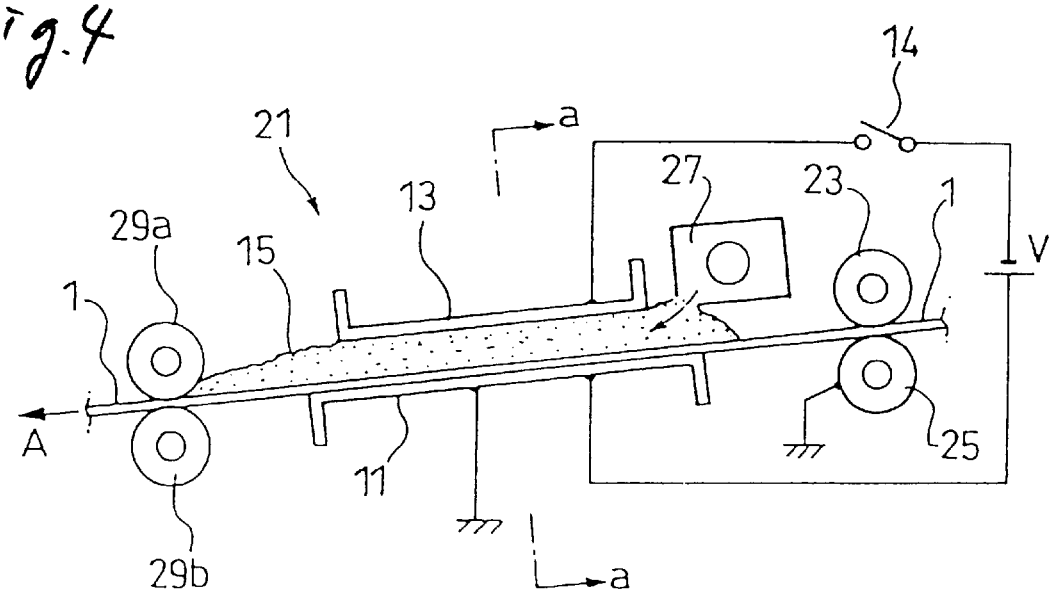
FIG. 4 is a schematic cross sectional view showing a first embodiment of a developing apparatus according to the present invention.

A developing apparatus for developing the master 1 according to the embodiment of the present invention will now be described. FIG. 4 is a schematic view showing the structure of the developing apparatus. The master 1 shown in FIG. 4 has a structure similar to that according to the first embodiment. Also the electrode 11 adjacent to the support member 3, the electrode 13 adjacent to the surface which is developed and the toner developer 15 are arranged to perform similar operations to those according to the first embodiment. This embodiment will be described by using the drawings and the like for use to described the first embodiment, if necessary.

A developing apparatus 21 incorporates a pair of delivery rollers 23 and 25 for nipping the master 1 to convey the same in a direction indicated with an arrow A; the electrode 11 adjacent to the support member 3 and the electrode 13 adjacent to the surface which is developed, the electrodes' 11 and 13 being electrodes described in the first embodiment; a toner spraying jig 27 for supplying developer (liquid toner) 15; and a pair of squeeze rollers 29*a* and 29*b* for conveying the master 1 and squeezing the developer 15.

The upper roller 23 of the pair of the delivery rollers 23 and 25 is made of insulating rubber and so forth. The lower roller 25 is made of metal, such as stainless steel and grounded as illustrated. The toner spraying jig 27 is disposed at an upstream position of the electrode 13 adjacent to the surface which is developed so as to spray the toner developer 15 to the upper surface of the master 1.

The pair of the squeeze rollers 29*a* and 29*b* squeeze and remove the developer 15 allowed to adhere to the surface of the master 1. Then, the squeeze rollers 29*a* and 29*b* convey the master 1 to a downstream position.

The cross sectional structure taken along line a-a shown in FIG. 4 is similar to that shown in FIG. 2. Since the master 1 has the structure described in the first embodiment, nipping of the master 1 by the pair of the delivery rollers 23 and 25 causes the electrode portions 5*a* to be brought into contact with the rollers 25 so as to be grounded.

When the master 1 is moved to the position at which the electrode 11 adjacent to the support member 3 is disposed, the conductive layer 5 is reliably made contact with the electrode 11 adjacent to the support member 3 through the electrode portions 5*a* during conveyance of the master 1 along the electrode 11 adjacent to the support member 3 in the direction indicated with the arrow A, as shown in FIG. 4.

Therefore, the developing apparatus 21 according to this embodiment is able to reliably neutralize the electrostatic latent image caused from the counter charge owing to the toner development as described with reference to FIG. 2. Therefore, a satisfactory image can be developed.

Figure 5:
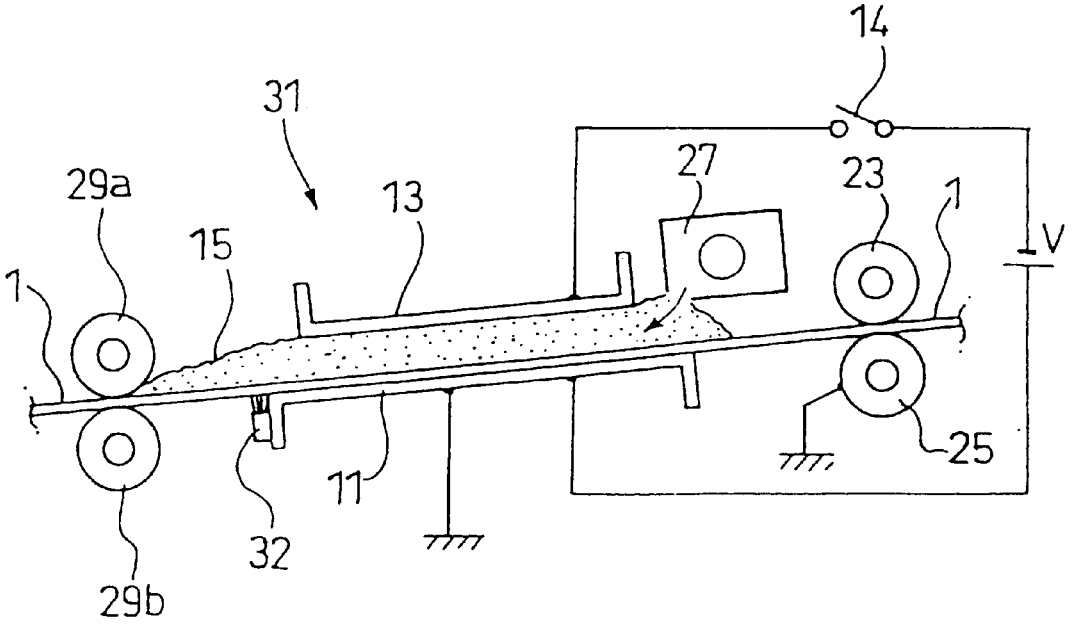
FIG. 5 is a schematic cross sectional view showing a second embodiment of a developing apparatus according to the present invention.
Figure 6:
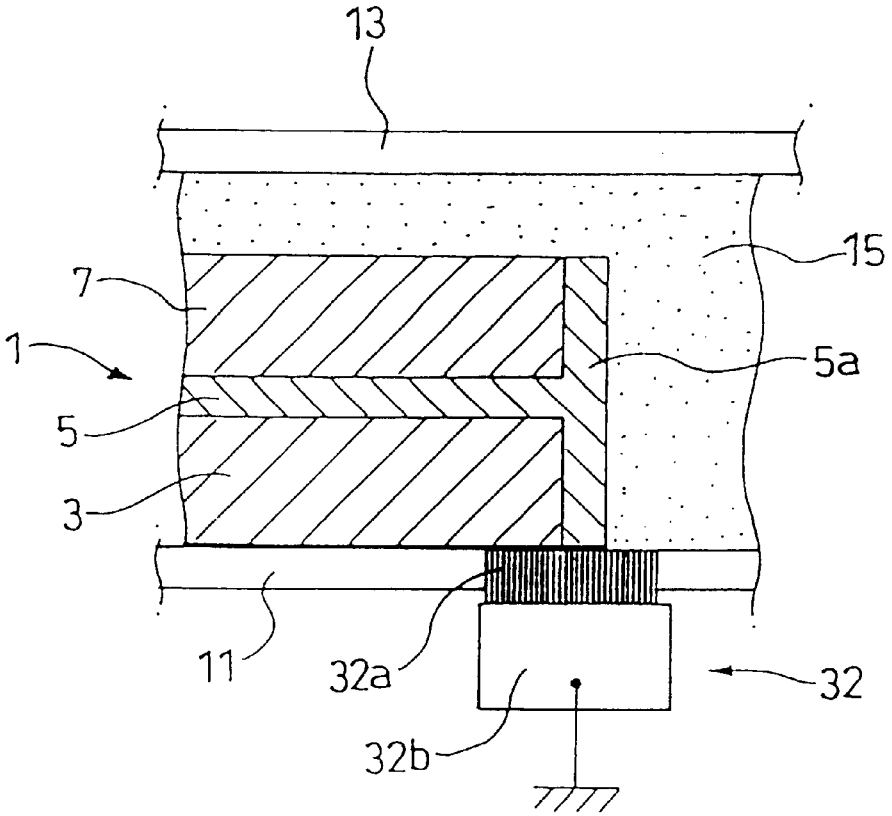
FIG. 6 is a cross sectional view showing an essential portion of the structure of a conductive brush.

Referring to FIGS. 5 and 6, a second embodiment of the developing apparatus will now be described. The major difference from a developing apparatus 31 according to this embodiment and the foregoing developing apparatus 21 will now be described. The difference lies in that a conductive brush 32 is provided for the developing apparatus 21 to reliably make contact with the electrode portions 5*a*. Therefore, the elements which perform similar operations to those of the developing apparatus 21 are given the same reference numerals. The similar elements are omitted from description.

As shown in FIG. 5, the conductive brush 32 is disposed at a downstream end of the electrode 11 adjacent to the support member 3. As shown in FIG. 6, the conductive brush 32 is constituted by vertically planting stainless steel wires 32*a* to have a height of about 1 mm in a base member 32*b*.

Since the base member 32*b* is made of a conductive material, the wires 32*a* are electrically connected to the electrode 11 adjacent to the support member 3 through the base member 32*b*. As a result, the master 1 is inevitably brought into contact with the delivery roller 25 and/or the conductive brush 32 during the toner development of the master 1. Therefore, a complete toner development can be performed.

The conductive brush 32 is located at the leading end of the electrode 11 adjacent to the support member 3 to correspond to the position at which the electrode portions 5*a* pass. Moreover, the width of the conductive brush 32 is made to be larger than the width of the electrode portions 5*a* as shown in FIG. 6 in consideration of a state in which the electrode portions 5*a* are shifted laterally when the master 1 meanders.

The foregoing structure causes the electrode portions 5*a* to be made contact with the electrode 11 adjacent to the support member 3 similarly to the foregoing structure and to rub and make contact with the conductive brush 32 during conveyance of the master 1. Therefore, grounding of the conductive layer 5 through the electrode portions 5*a* can reliably be performed. Thus, a satisfactory development can be performed.

Figure 7:
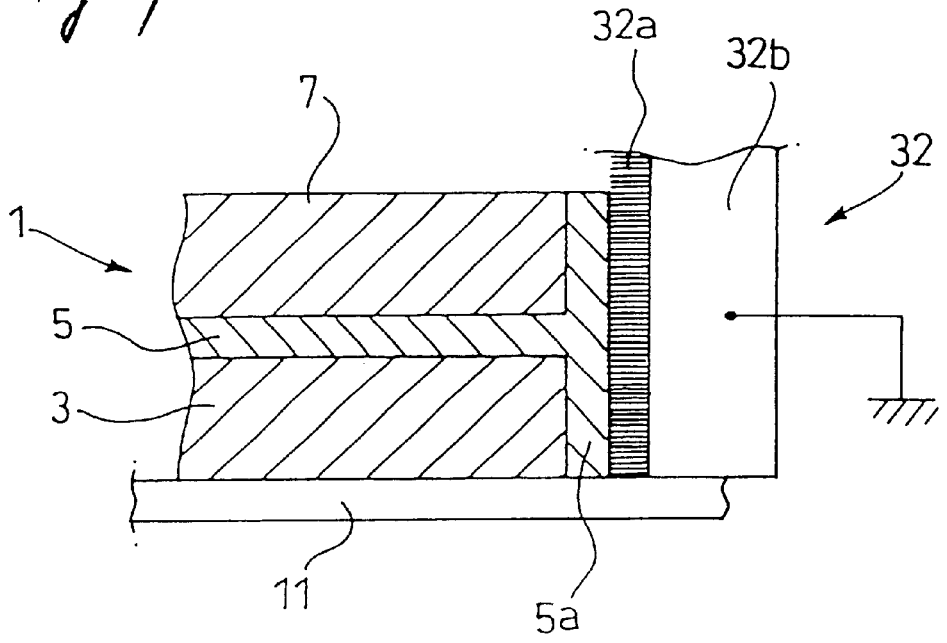
FIG. 7 is a cross sectional view showing an essential portion of another example of the structure of the conductive brush.

The structure of the conductive brush 32 is not limited to the foregoing description. For example, the conductive brushes 32 may be disposed to rub the two side surfaces of the master 1 and the width of each conductive brush 32 is made to be larger than the thickness of the master 1, as shown in FIG. 7.

The foregoing structure, in which the conductive brushes 32 are grounded, enables the electrode portions 5*a* to reliably be grounded. Therefore, en effect similar to that obtainable from the foregoing structure can be obtained.

Figure 8:
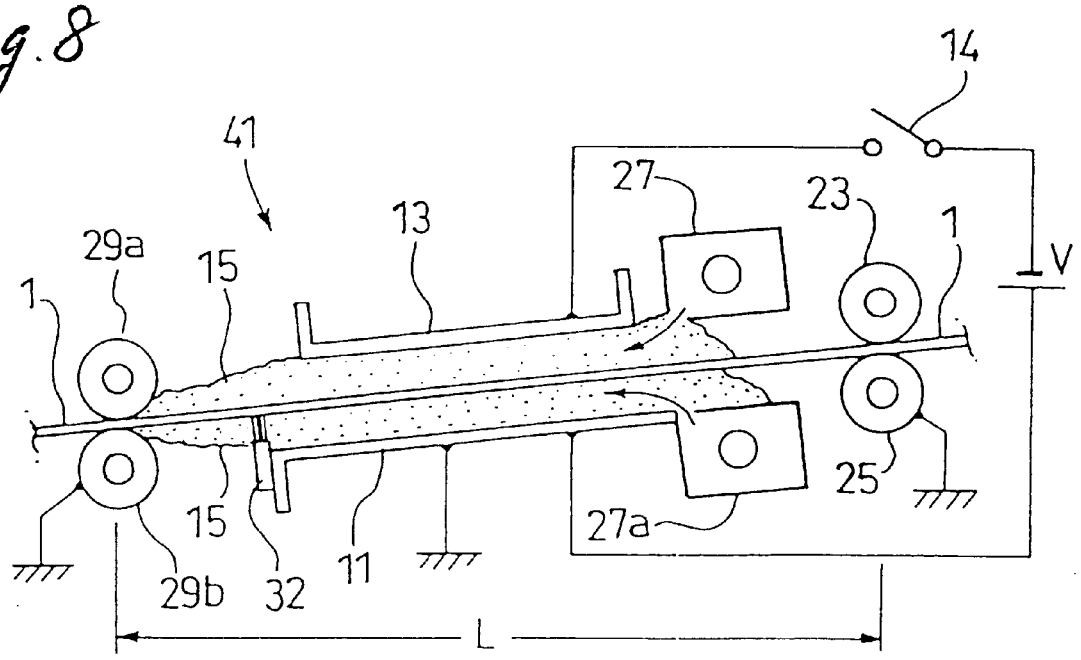
FIG. 8 is a schematic cross sectional view showing a third embodiment of a developing apparatus according to the present invention.
Figure 9:
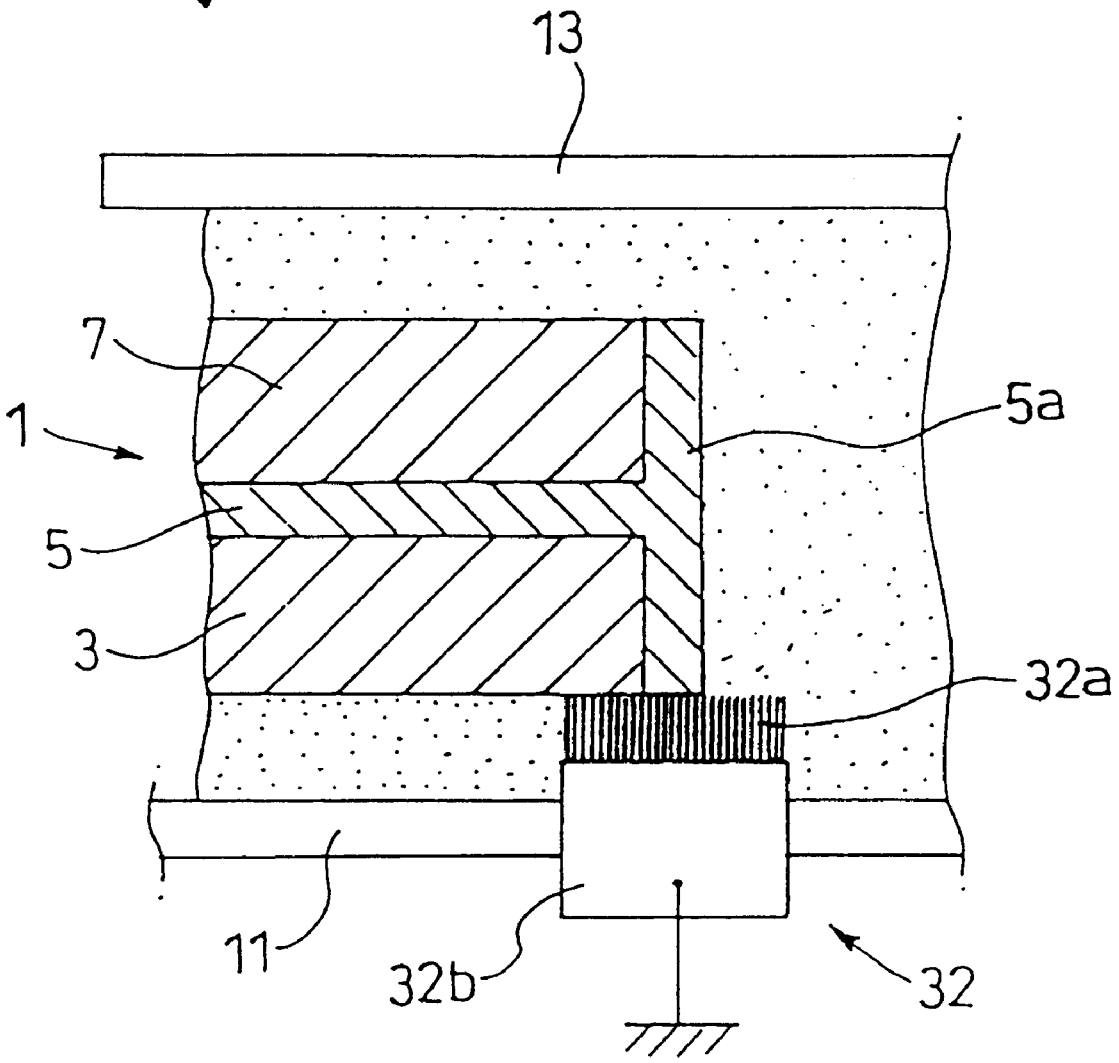
FIG. 9 is a cross-sectional view showing an essential portion of the structure of a conductive brush of the apparatus of FIG. 8.

Referring to FIGS. 8 and 9, a third embodiment of the developing apparatus will now be described. A developing apparatus 41 according to this embodiment and the foregoing developing apparatuses 21 and 31 are different from each other in the following structures.

A first difference lies in that the squeeze roller 29 of the pair of the squeeze rollers 29*a* and 29*b* disposed at downstream positions of the electrode 11 adjacent to the support member 3 adjacent to the support member is grounded.

A second difference lies in that the developer 15 is supplied to the upper and lower surfaces of the master 1. As a matter of course, the same effect can be obtained when the developing apparatus 31 is employed such that the developer 15 is supplied to the upper and lower surfaces of the master 1. Therefore, the developing apparatus 41 incorporates the toner spraying jigs 27 and 27*a* disposed at upper and lower positions with respect to the passage for the master 1.

When the master 1 has been introduced into the developing apparatus 41 shown in FIG. 8, the master 1 is initially nipped by the delivery rollers 23 and 25. Thus, the upper and lower ends of the electrode portions 5*a* are brought into contact with the delivery rollers 23 and 25. Since the roller 25 is made of stainless steel and grounded, the conductive layer 5 is grounded through the electrode portions 5*a*.

The master 1 is conveyed to the downstream position while it is being grounded as described above. Since the developer 15 is sprayed from also the lower toner spraying jig 27*a*, the master 1 is conveyed through the developer 15. The length of the master 1 is made to belonger than the distance L between the delivery rollers 23 and 25 and the pair of the squeeze rollers 29*a* and 29*b*. Therefore, the conductive layer 5 of the master 1 is first grounded by the roller 25. Then, the leading end of the master 1 is nipped by the pair of the squeeze rollers 29*a* and 29*b*. Thus, grounding caused by the squeeze roller 29*b* is simultaneously be performed. When the master 1 is conveyed, the trailing end is separated from the roller 25. Then, grounding caused by the squeeze roller 29*b* is continued.

Therefore, the developing apparatus 41 is structured such that the master 1 is grounded by the roller 25 and/or the roller 29*b* during the conveyance of the master 1 in the developing apparatus 41, that is, during development.

As described above, the conductive layer 5 is inevitably grounded during the development of the master 1. Therefore, the above-mentioned satisfactory development can be performed.

Also the developing apparatus 41 may be provided with the conductive brush 32 as a substitute for the conductive squeeze roller 29*b*, as shown in FIG. 8. Since the master 1 of the developing apparatus 41 is allowed to float from the electrode 11 adjacent to the support member 3, the structure as shown in FIG. 9 is formed such that the conductive brush 32 is allowed to project over the electrode 11 adjacent to the support member 3 so as to be brought into contact with the electrode portions 5*a*. When both of the conductive squeeze roller 29*b* and the conductive brush 32 are employed, defective grounding can completely be prevented.

The above-mentioned structure is formed such that the lower roller 25 of the rollers 23 and 25 disposed immediately before conveyance into the toner developing portion is made of metal, such as stainless steel. When the roller 25 is an insulating roller, a conductive brush may be provided which is arranged to be brought into contact with the electrode portions 5*a* of the master 1 immediately before the toner development operation. The foregoing conductive brush is grounded.

EXAMPLES

Examples of the master 1 will sequentially be described.

Example 1

The two sides of bond paper having a grammage of 110 g/cm$^2$ were subjected to a discharging process which was a conventional method for realizing adhesiveness of a coating material. Then, a hot-melt laminating machine was operated to laminate low-density polyethylene to have a thickness of 20 mm on either surface and a thickness of 25 mm on another surface so that a water-proofing insulating support member was manufactured. Also the surface on which polyethylene was laminated to have the thickness of 20 mm was subjected to the discharging process to obtain the adhesiveness of the coating material. To form a conductive layer on the foregoing surface, the following fluid dispersion (Composition 1) was applied to realize a dry quantity of coating of 5 g/cm$^2$ by using a wire bar.

| (Composition 1) Conductive Fluid Dispersion | |
|---|---|
| styrene-butadiene latex (containing solid components by 50 wt %) | 100 parts by weight |
| carbon black | 10.5 parts by weight |
| clay (water dispersion containing solid components by 45 wt %) | 100 parts by weight |
| water | 35 parts by weight |

The surface resistance of the foregoing surface was measured by using UNIVERSAL ELECTROMETER MMA2-17A and ROOMTEMPERATURE RESISTIVITY CHAMBER MODEL p-601 manufactured by Kawaguchi. As a result, a value of $4\times10^7$ (W/cm) was obtained. To form the photoconductive layer on the above-mentioned surface, the following fluid dispersion (Composition 2) was uniformly applied by using a wire bar to realize a quantity of solid components of coating of 25 g/cm$^2$. Then, drying was performed in an atmosphere of 100° C. for one minute. Then, the support member was allowed to stand in a dark room maintained at 20° C. and 60%RH for 24 hours. Thus, a master was obtained.

| (Composition 2) Fluid Dispersion for Photconductive Layer | |
|---|---|
| impalpable powder of photconductive zinc oxide | 100 parts by weight |
| acrylic resin | 20 parts by weight |
| toluene | 125 parts by weight |
| acid phthalic anhydride | 0.1 part by weight |
| rose bengal (4% methanol solution) | 4.5 parts by weight |

To form electrode portions on the two sides in the conveying direction in a machine for making the master, sponge impregnated with the following fluid dispersion (Composition 3) was used to coat the master to realize an average quantity of coating of 4 g/cm$^2$ in a dry state.

| (Composition 3) Fluid Dispersion for Electrode Portion | |
|---|---|
| acryl latex (40 wt %) | 100 parts by weight |
| carbon black | 25 parts by weight |
| water | 125 parts by weight |

The electrode adjacent to the support member of a toner developing portion (corresponding to the developing apparatus) of a plate making machine ELP330RX manufactured by Fuji Photo Film was changed from a standard structure shown in FIG. 4 to a structure in which a conductive brush made of stainless steel was disposed at the rear end of the electrode adjacent to the support member, as shown in FIG. 5. Thus, the manufactured master was formed into the printing plate. An original document had two solid images each of which was formed into a 15 cm'15 cm square. The solid images were disposed at positions adjacent to the leading end of the master and adjacent to the trailing end of the same. The reflective density of each of the solid portions of the obtained printing plate was measured by a Macbeth reflective densitometer (RD-517). As a result, the reflective densities of both of the solid portions were 1.11.

The foregoing printing plate was printed by using an automatic printer 611XLA-2 manufactured by Hamada Printing Machine Co. Ltd. As a result of the printing operation, no contamination was detected in non-image portions, sharp characters were formed, the 15 cm'15 cm solid portions were formed uniformly and ink was sufficiently deposited.

As described above, the electrode portions were brought into electrically contact with both of the metal conveying roller 25 which was always in an earth state and the conductive brush 32 made of stainless steel or either of the foregoing roller 25 or the brush 32 during existence of the master 1 in the toner developer 15. Therefore, above-mentioned plate making and printing were enabled.

Comparative Example 1-1

A sample was manufactured by a method which was the same as that employed in Example 1 except for a structure that the electrode portions were not formed on the two sides of the master. The developing apparatus incorporating the standard electrode adjacent to the support member shown in FIG. 4 was operated so that the original document employed in Example 1 was used to perform plate making. The reflective density of the solid portions on the obtained printing plate was 0.43 at the leading-end solid portion and 0.40 at the trailing-end solid portion. The values were excessively low as compared with the values obtained in Example 1.

The printing plate was printed by a method similar to that employed in Example 1. Although no contamination occurred in the non-image portions, characters were unsatisfactory from a viewpoint of the sharpness. What is worse, both of the 15 cm×15 cm solid portions were unsatisfactory in the deposition of ink. That is, results of printing was unsatisfactory.

Comparative Example 1-2

A sample was manufactured by a method which was the same as that employed in Example 1 except for the structure that the electrode portions were not formed on the two sides of the master. The foregoing sample was formed into a printing plate by the developing apparatus having the electrode adjacent to the support member shown in FIG. 5 by using the original document employed in Example 1. The reflective density of the solid portions of the obtained printing plate was such that the densities at the leading end and trailing end solid portions were 0.54. The values were excessively low as compared with the results obtained in Example 1.

The obtained printing plate was printed by a method similar to that employed in Example 1. Although no contamination was detected in the non-image portions, characters were insufficient in the sharpness. Moreover, ink was not deposited on both of the 15 cm×15 cm solid portions. Thus, results of printing were unsatisfactory.

Example 2

The lower roller of the upper and lower squeeze rollers at the in the rear of the outlet portion of the toner developing portion of the printing making machine ELP33ORX manufactured by Fuji Photo Film was changed to an NBR rubber roller having a specific volume resistance of $1.1\times10^5$ (W·cm) and containing carbon black added thereto. Moreover, electrical grounding was performed. A master manufactured by a method which was the same as that employed in Example 1 was print-made by using the original document which was the same as that employed in Example 1. Then, the plate making machine was operated to make the plate. The reflective densities of the solid portions in the formed image were such that it was 1.06 at the leading-end solid portion and 1.05 at the trailing-end solid portion.

The printing plate was printed by a method similarly to that employed in Example 1. As a result, no contamination was detected in the non-image portions, characters were satisfactory from a viewpoint of the sharpness and ink was sufficiently deposited on the surfaces of both of the 15 cm×15 cm leading-end and trailing-end solid portions. Thus, a satisfactory print was obtained.

Example 3

The structure of the toner developing portion of the plate making machine ELP330RX manufactured by Fuji Photo Film was changed such that toner developer solution was injected from a position below the electrode adjacent to the support member in such a manner that the master was conveyed without any contact with the electrode adjacent to the surface which was developed and the electrode adjacent to the support member, as shown in FIG. 8. Moreover, the lower roller of the upper and lower squeeze rollers in the rear of the outlet portion of the toner developing portion was changed to an NBR rubber roller having a specific volume electric resistance of $1.1\times10^5$ (W·cm) and containing carbon black added thereto. Moreover, electrical grounding was performed.

A master manufactured by a method which was the same as that employed in Example 1 was plate-made by the foregoing plate making machine by using the same original document which was the same as that employed in Example 1. The reflective densities at the solid portions of the obtained printing plate were identically 1.14 in both of the leading-end and trailing-end solid portions.

The foregoing printing plate was printed by a method similarly to that employed in Example 1. As a result, no contamination was detected in the non-image portions, characters were satisfactory from a viewpoint of the sharpness and ink was sufficiently deposited on the surfaces of both of the 15 cm×15 cm leading-end and trailing-end solid portions. Thus, a satisfactory print was obtained.

Example 4

To realize adhesiveness of a coating material, either side surface of a polyethylene terephthalate film having a specific volume electric resistance of $10^{15}$ W·cm and a thickness of 100 mm was subjected to a discharging process. Then, a conductive layer and a photoconductive layer were sequentially formed on the surface of the foregoing film by coating by a method which was the same as that employed in Example 1. Then, electrode portions were formed on the two sides in the conveying direction in the plate making machine by coating by a method similar to that employed in Example 1. Then, the plate making machine having the structure shown in FIG. 5 was operated similarly to Example 1 so that the master was plate-made. The reflective densities at the 15 cm×15 cm solid portions on the obtained printing plate were 1.12 at the leading-end solid portion and 1.13 at the trailing-end solid portion. The printing plate was printed similarly to Example 1. As a result, no contamination was detected in the non-image portions, characters were satisfactory from a viewpoint of the sharpness and the 15 cm×15 cm leading-end and trailing-end solid portions were formed uniformly in a state ink was sufficiently deposited.

The electrophotographic master plate for printing according to the present invention incorporates the support member made of resin exhibiting an excellent insulating characteristic and the conductive layer and the photoconductive which are laminated on the support member. Moreover, the electrode portions connected to the conductive layer are formed on the widthwise directional side surfaces. When development is performed, the electrophotographic master plate for printing is conveyed through the developer enclosed between the pair of the electrodes applied with voltage. Since the electrode portions are formed, the electrode portions can easily and reliably be connected to either electrode. Therefore, the potential of the conductive layer can be made to be the same as that of either electrode through the electrode portions.

Therefore, neutralization of an electrostatic latent image caused from counter charges owing to the toner development can reliably and quickly be performed. Also thanks to use of the support member made of resin exhibiting excellent flatness, a satisfactory image can be developed.

The developing apparatus for developing the foregoing electrophotographic master plate for printing is arranged before the toner development as follows: the electrode portions of the electrophotographic master plate for printing are brought into contact with at least either of the lower conductive roller made of metal or the like and constituting the pair of rollers which nip and convey the electrophotographic master plate for printing at position in front of the toner developing portion or the conductive brush disposed at the position at which contact with the electrode portions is permitted. Thus, the conductive layer is grounded through the electrode portions. After the toner development has been performed, the electrode portions of the electrophotographic master plate for printing are brought into contact with at least either of the lower conductive roller of the pair of the squeeze rollers or the provided conductive brush. Thus, the conductive layer is grounded through the electrode portions.

Therefore, simultaneously with conveyance of the electrophotographic master plate for printing into the developing apparatus, counter charges caused from the toner development can quickly be supplied from the ground. Therefore, neutralization of the electrostatic latent image can reliably and quickly be performed. As a result, satisfactory development can be performed.

What is claimed is:

1. A method of developing an electrophotographic master plate for printing which incorporates an insulating support member, on which a conductive layer and a photoconductive layer are laminated, and electrode portions formed on the widthwise-directional side surfaces of said insulating support member and said photoconductive layer and arranged to electrically be connected to said conductive layer, said method of developing an electrophotographic master plate for printing comprising the step of: always electrically connecting said conductive layer to a conductive member through said electrode portions to ground said conductive layer during conveyance of said electrophotographic master plate for printing through a toner developer enclosed between a pair of electrodes disposed opposite to each other.

2. An apparatus for developing an electrophotographic master plate for printing which incorporates an insulating support member, on which a conductive layer and a photoconductive layer are laminated, and electrode portions formed on the widthwise-directional side surfaces of said insulating support member and said photoconductive layer and arranged to electrically be connected to said conductive layer, said apparatus for developing an electrophotographic master plate for printing comprising: a conductive member which is previously grounded and is provided for a passage for conveying said electrophotographic master plate for printing to a toner developer enclosed between a pair of electrodes disposed opposite to each other, wherein said electrode portions and said conductive rollers are always brought into contact with each other during conveyance of said electrophotographic master plate for printing by conveying means so that said conductive layer is grounded.

3. The apparatus for developing an electrophotographic master plate for printing according to claim 2, wherein said conductive member is conducitve rollers for conveying said electrophotographic master plate.

4. The apparatus for developing an electrophotographic master plate for printing according to claim 2, wherein an electrode adjacent to said support member of said electrodes is previously grounded, and said electrode portions are brought into contact with said electrode adjacent to said support member during conveyance of said electrophotographic master plate for printing so that said conductive layer is grounded.

5. The apparatus for developing an electrophotographic master plate for printing accorrding to claim 2, wherein said conductive member is a conductive brush.

6. The apparatus for developing an electrophotographic master plate for printing accorrding to claim 2, wherein said conductive member is at least one of a conductive roller, an electrode adjacent to said support member, and a conductive brush, which are previously grounded.

* * * * *